US007037884B2

(12) United States Patent
Man

(10) Patent No.: US 7,037,884 B2
(45) **Date of Patent: *May 2, 2006**

(54) ALKALINE CLEANERS BASED ON ALCOHOL ETHOXY CARBOXYLATES

(75) Inventor: Victor Fuk-Pong Man, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 155 days.

This patent is subject to a terminal disclaimer.

(21) Appl. No.: 10/293,572

(22) Filed: Nov. 12, 2002

(65) Prior Publication Data

US 2003/0139315 A1 Jul. 24, 2003

Related U.S. Application Data

(63) Continuation-in-part of application No. 09/872,675, filed on Jun. 1, 2001, now Pat. No. 6,479,453, which is a continuation of application No. 08/469,809, filed on Jun. 6, 1995, now Pat. No. 6,274,541, which is a continuation of application No. 08/200,631, filed on Feb. 23, 1994, now abandoned.

(51) Int. Cl.
*C11D 1/06* (2006.01)
*C11D 3/33* (2006.01)
*B08B 7/00* (2006.01)

(52) U.S. Cl. ..... 510/365; 510/109; 510/238; 510/435; 510/480; 510/506; 134/40

(58) Field of Classification Search ..... 510/365, 510/109, 238, 435, 480, 506; 134/40
See application file for complete search history.

(56) References Cited

U.S. PATENT DOCUMENTS

| | | | | |
|---|---|---|---|---|
| 3,298,956 | A | 1/1967 | Irani et al. | |
| 3,528,923 | A | 9/1970 | Atherton et al. | |
| 3,660,470 | A | 5/1972 | Hirst | |
| 3,767,584 | A | 10/1973 | Hirst | |
| 3,850,834 | A | 11/1974 | Hellsten et al. | |
| 3,941,710 | A | 3/1976 | Gilbert et al. | |
| 4,000,081 | A | 12/1976 | Woo | |
| 4,399,050 | A | 8/1983 | Bentham et al. | |
| 4,576,729 | A * | 3/1986 | Paszek et al. | 510/319 |
| 4,797,223 | A | 1/1989 | Amick et al. | |
| 4,861,518 | A | 8/1989 | Morganson et al. | |
| 4,891,149 | A | 1/1990 | Nagarajan et al. | |
| 5,244,593 | A * | 9/1993 | Roselle et al. | 510/127 |
| 5,298,195 | A | 3/1994 | Brumbaugh | |
| 5,376,310 | A * | 12/1994 | Cripe et al. | 510/235 |
| 5,378,409 | A * | 1/1995 | Ofosu-Asante | 510/235 |
| 5,415,813 | A | 5/1995 | Misselyn et al. | |
| 5,736,503 | A | 4/1998 | Vinson | |
| 6,274,541 | B1 | 8/2001 | Man | |
| 6,479,453 | B1 * | 11/2002 | Man | 510/365 |

FOREIGN PATENT DOCUMENTS

| | | |
|---|---|---|
| CA | 1232817 | 2/1988 |
| DE | 3639885 | 6/1988 |
| EP | 0 121 286 | 10/1984 |
| EP | 2 076 010 | 11/1985 |
| NL | 7 107 579 | 12/1972 |
| WO | WO 92/0877 | 5/1992 |

OTHER PUBLICATIONS

Foley, J.T., "Hard Surface Cleaners Present New Opportunities for Formulators", *Soap-Cosmetics-Chemical Specialities*, vol. 63, p. 38(3) Sep. 1987.
Derwent Publications Ltd., London, GB; Class A96, AN 93-299874 & JP, A/05 214 362 (Lion Corp.) Aug. 24, 1993.

* cited by examiner

*Primary Examiner*—Lorna M. Douyon
(74) *Attorney, Agent, or Firm*—Merchant & Gould P.C.

(57) ABSTRACT

An alkaline cleaner composition comprising an alkyl or alkylaryl ethoxy carboxylate, a strong chelating agent and a source of alkalinity, its manufacture and use in removing greasy soil from hard surface areas is described. The compositions are especially effective in removing lime-soaps in such greasy soil especially on institutional and commercial kitchen floors.

44 Claims, 4 Drawing Sheets

Figure 1. Red Food Soil Removal:
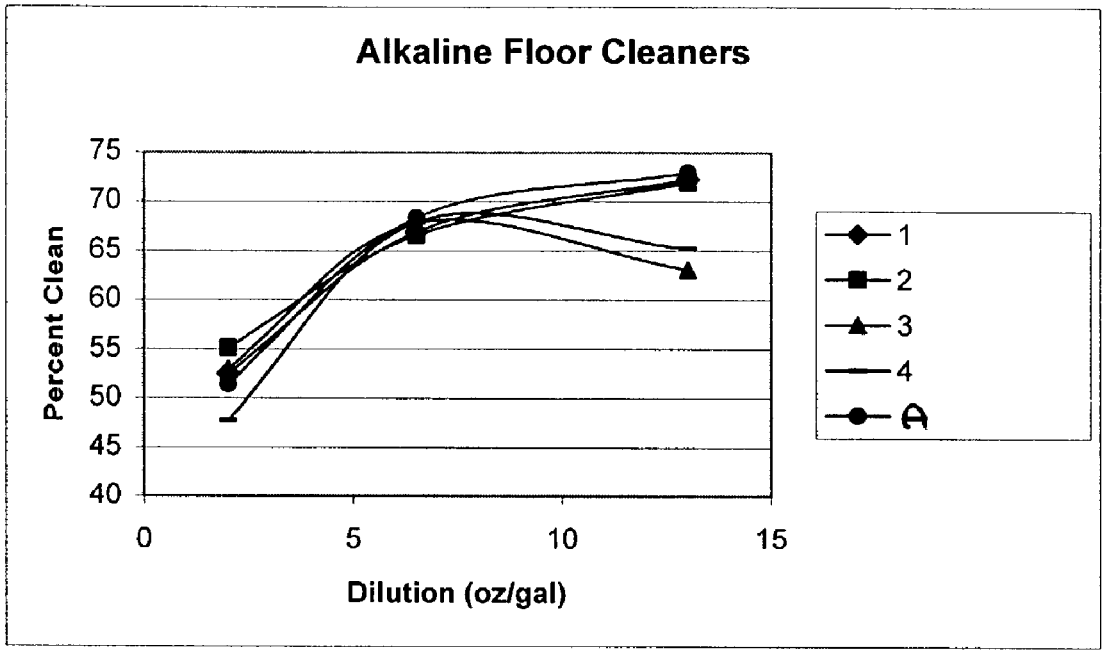

Figure 2. Black Oily Soil Removal:
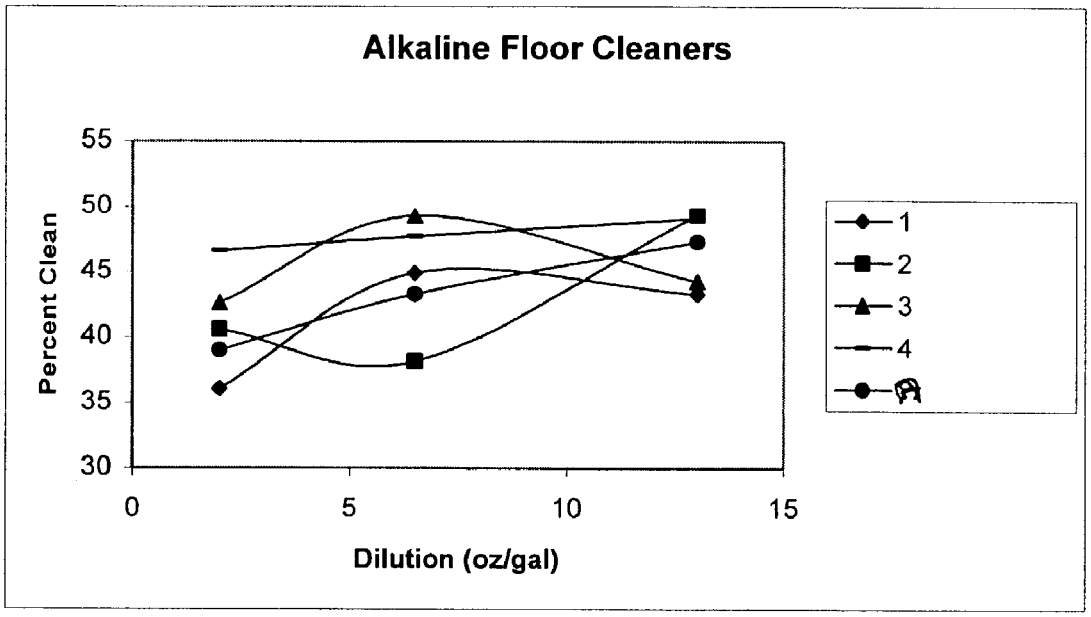

Figure 3. Red Food Soil Removal:
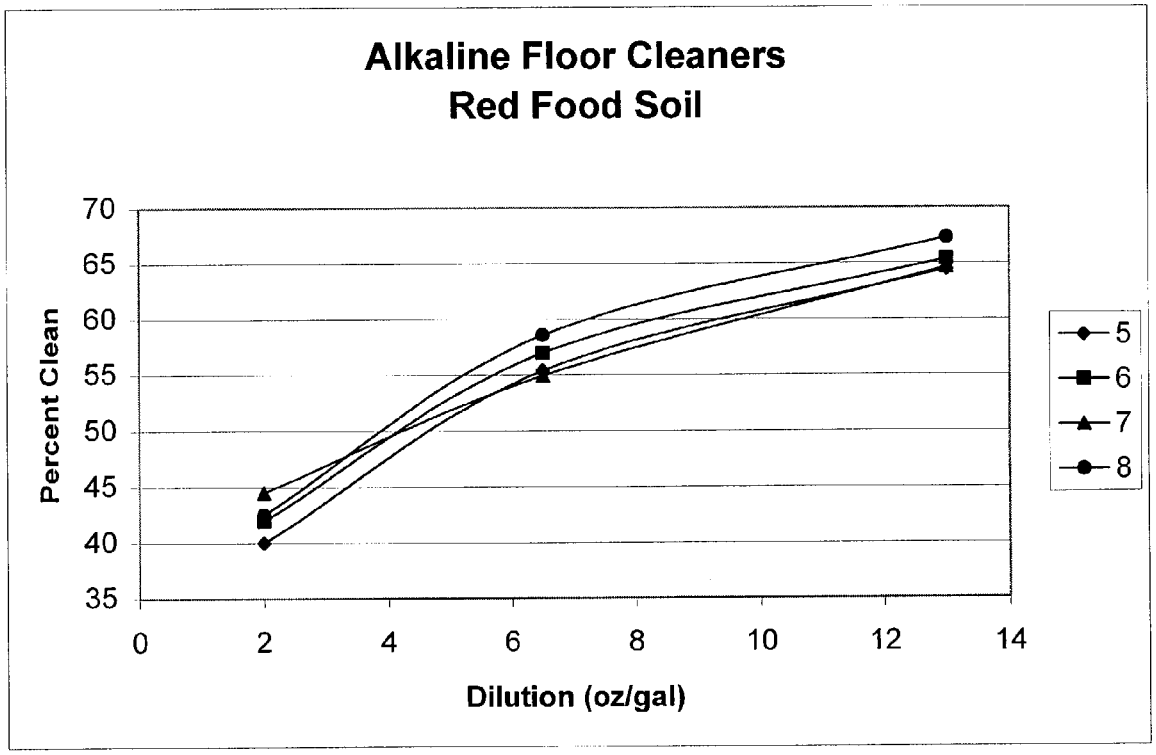

Figure 4. Black Oily Soil Removal:
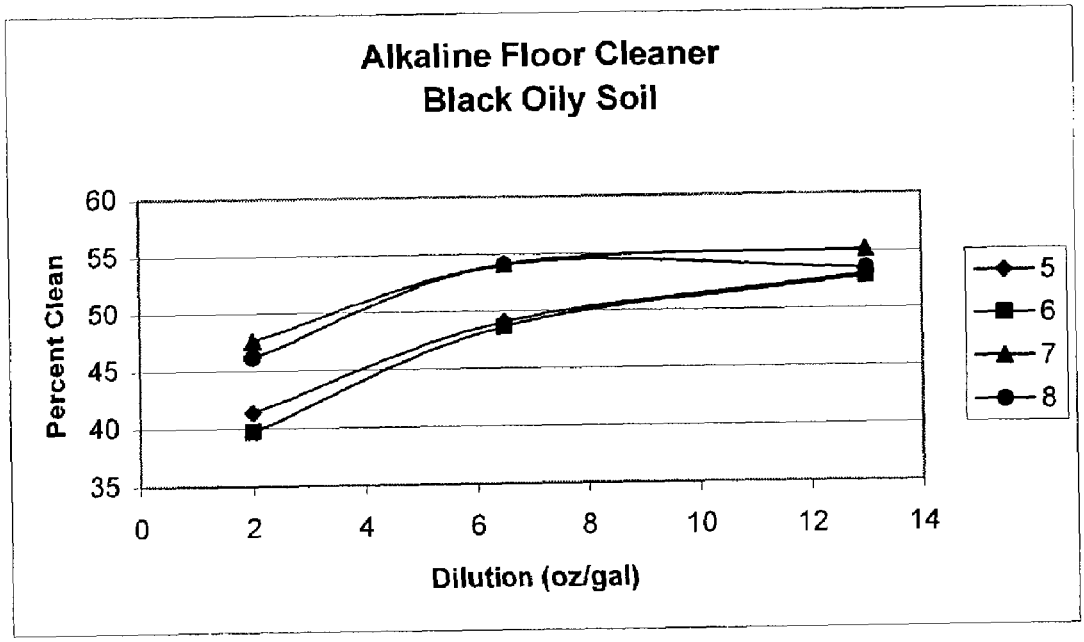

ALKALINE CLEANERS BASED ON ALCOHOL ETHOXY CARBOXYLATES

CROSS REFERENCE TO RELATED APPLICATIONS

The present application is a continuation in part of U.S. patent application Ser. No. 09/872,675, filed Jun. 1, 2001, now U.S. Pat. No. 6,479,453, which is a continuation of Ser. No. 08/469,809, filed Jun. 6, 1995, now U.S. Pat. No. 6,274,541, which is a continuation of Ser. No. 08/200,631, filed Feb. 23, 1994, now abandoned.

BACKGROUND OF THE INVENTION

The present invention is related to an alkaline cleaner for removal of greasy soil from hard surface areas. It is especially effective in removing not only the grease but also grease plus lime-soaps found in institutional and commercial kitchens, in other food preparation environments, in bathrooms or lavatories, and on vehicles. Prior to the present invention, the greases, particularly in combination with lime-soaps, have been difficult to clean from hard surfaces such as ceramic tiles, metal or enamel surfaces, or countertops. This difficulty apparently is due to unsaturated portions of materials being partially cross-linked which upon aging further polymerize and also due to the general hydrophobic nature of the soil.

Most lime-soap dispersants previously described contain sulfated, sulfonated or phosphonated compounds. Alkyl or alkylaryl ethoxy carboxylates are known in the art as mild surfactants for use in liquid detergent compositions. They have been described as being poor in grease cutting and require the use of other surfactants to achieve the desired cleaning. For example, international patent application, publication number WO92/08777 describes a light-duty dishwashing detergent composition containing an alkyl ethoxy carboxylate surfactant and calcium or magnesium ions and a moderate complexing agent. It was therefore surprising to find that alkyl and alkylaryl ethoxy carboxylates of the present invention are effective in removing greasy soil, particularly greasy soil containing lime-soaps, when such active ingredients are combined with a strong chelating agent and a source of alkalinity.

SUMMARY OF THE INVENTION

Accordingly the present invention includes an alkaline cleaner for removing greasy soil, even those soils containing lime-soaps. The cleaner can work on hard surfaces such as quarry or ceramic tiles or ceramic surfaces (e.g., in commercial and institutional kitchens, in bathrooms, in lavatories), metal or coated metal surfaces (e.g., on vehicles), and glass or enamel surfaces.

The alkaline cleaning composition includes:

(1) an effective detersive amount of alkyl or alkylaryl ethoxy carboxylates of the formula $$R—O—(CH_2CH_2O)_n(CH_2)_m—CO_2X$$

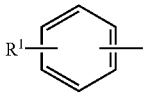

wherein R is a $C_8$ to $C_{22}$ alkyl group or in which $R^1$ is a $C_4$–$C_{16}$ alkyl group, n is an integer of 1–20, m is an integer of 1–3, and X is hydrogen, sodium, potassium, lithium, ammonium, or an amine salt selected from monoethanolamine, diethanolamine and triethanolamine;

(2) an effective amount of a strong chelating agent;

(3) an effective amount of a source of alkalinity, and, optionally, (4) a diluent.

The cleaner composition can be sold as a concentrate or in the form of a dilute aqueous solution. The concentrate is preferred when sold to restaurants and institutions. Application of the concentrate is then carried out by known dilution method.

BRIEF DESCRIPTION OF THE DRAWINGS

FIGS. 1–4 are graphs showing soil removal properties of dilutions of the alkaline cleaner compositions on soils.

DETAILED DESCRIPTION

Definitions

As used herein including the claims, the term "wt %" refers to the weight proportion based upon the total weight of the composition.

As used herein including the claims, the phrase "consisting essentially of" refers to a composition that includes the listed ingredients and that can also include added optional ingredients so long as those added optional ingredients do not change the fundamental nature of the composition and do not change the functional characteristics of the compositions, such as reduced drying time and effective removal of greasy and/or lime soap soil.

Cleaning Compositions and Methods

Cleaning Compositions

The alkaline cleaner composition may be in solid or liquid form. In liquid form, the composition is preferably sold as a concentrate and used as a dilute aqueous solution. The composition includes an effective detersive amount of an alkyl or alkylaryl ethoxy carboxylate, an effective amount of a chelating agent and an effective amount of a source of alkalinity. The composition can also contain a diluent. The diluent for a concentrate may be water, alcohol, or an aqueous alcohol mixture. In dilute form, the diluent is water. The composition can also contain a water conditioning agent and other typical detergent additives such as dyes, perfumes, grease cutting solvents, and the like.

By effective detersive amount is meant an amount of active ingredient required to remove grease, oily soil, and/or food soil from a hard surface. These soils can also include lime-soap.

By an effective amount of a strong chelating agent is meant the amount required to remove the alkaline earth salts (Ca or Mg) from the water hardness used in ordinary cleaning. The use of chelating agents also help break up the lime-soaps under alkaline conditions and can release soaps that can help in the cleaning process.

By effective amount of a source of alkalinity is meant enough alkaline materials to break apart semi-polymerized soils formed from fats and lime-soaps which are on hard surfaces. The unsaturated portions of some fats are partially cross-linked and upon aging the soils can be further polymerized. Thus highly alkaline materials such as caustics or strong amines are helpful in breaking these apart.

As a preferred alkaline cleaning composition, alkyl and alkylaryl ethoxy carboxylates can be present in an amount ranging from about 0.1 to 20 wt %, the strong chelating agent being in the range of about 1–20 wt %, and the source of alkalinity being in the range of about 0.5–40 gross wt % or in the range of about 0.1–30 active wt %. These amounts can be higher in solid compositions.

In an embodiment, more preferred compositions include:

(1) about 1–5 wt % of alkyl or alkylaryl ethoxy carboxylate;

(2) about 10–15 wt % of a strong chelating agent; and (3) about 2–12 wt % of a source of alkalinity.

In an embodiment, cleaning compositions include:

(1) about 1–5 wt % of alkyl or alkylaryl ethoxy carboxylate;

(2) about 2–15 wt % of a strong chelating agent; and (3) about 1–6 active wt % of a source of alkalinity.

The source of alkalinity is normally higher in the above range when the composition is used for commercial and institutional kitchen floors. Since the composition is useful for cleaning ceramic surfaces, the composition may also be applied in diluted form in cleaning household bathroom tiles as well as bathroom tiles in commercial locations. In this aspect, the percentage of source of alkalinity would be closer to the bottom of the above range, e.g. on or about the 2% level.

The quantity of the source of alkalinity can be expressed in two ways. The quantity of the source of alkalinity can be expressed as the amount added to make up the cleaning composition. For example, a composition can be made up with 10 wt-% of ethylenediaminetetraacetic acid (EDTA acid) and 8 wt-% potassium hydroxide. However, substantially all of the potassium hydroxide will be consumed by partially neutralizing the EDTA to include its potassium salt. Little or none of the potassium hydroxide will remain to provide strong alkalinity for cleaning. As used herein, "gross" or "total" wt-% of source of alkalinity refers to the amount employed to make up a composition, some or all of which may be neutralized and unavailable as strong alkalinity for cleaning.

Alternatively, the quantity of the source of alkalinity can be expressed as the amount of the source alkalinity remaining after other ingredients making up the composition have been neutralized. That is, the amount of the source of alkalinity present in the cleaning composition. For example, a composition can include 10 wt-% of EDTA in the form of its tetrapotassium salt and 12 wt-% potassium hydroxide. In this composition, none of the potassium hydroxide is consumed neutralizing the EDTA. The composition includes 12 wt-% potassium hydroxide that is available as alkalinity for cleaning. As used herein, "net" or "active" wt-% of source of alkalinity refers to the amount of the source alkalinity remaining after other ingredients making up the composition have been neutralized.

In an embodiment, the net or active amount of source of alkalinity can be about 0.1 to about 30 wt-%, about 1 to about 15 wt-%, or about 2 to about 7 wt-%.

Preferred alkyl or alkylaryl ethoxy carboxylates of the above formula are those where n is an integer of 4 to 10 and m is 1.

Also preferred carboxylates are those alkyl carboxylates where R is a $C_8$–$C_{16}$ alkyl group. Most preferred of the alkyl ethoxy carboxylates are those where R is a $C_{12}$–$C_{14}$ alkyl group, n is 4 and m is 1.

In the alkylaryl series, a preferred embodiment is where R is of the formula

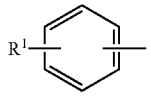

in which $R^1$ is a $C_6$–$C_{12}$ alkyl group. Most preferred is a carboxylate where $R^1$ is a $C_9$ alkyl group, n is 10 and m is 1.

The alkyl and alkylaryl carboxylates may be purchased as surfactants from commercial stores. These carboxylates are typically available as the acid forms, which require neutralization in the alkaline cleaning composition.

Alternatively, the carboxylates can be made by known synthetic methods starting with a fatty alcohol in the alkyl ethoxy carboxylate series. This fatty alcohol can be reacted with ethylene oxide to prepare the required number of ethoxy linkages. The resulting ethoxy alcohol is then further reacted with a halo carboxylic acid such as, for example, halo-acetic acid, halo-propionic acid or halo-butyric acid to form the desired carboxylate.

In the alkylaryl series, an alkylated phenol can be reacted in the same manner with ethylene oxide and further with the halo carboxylic acid to form the desired carboxylate.

As an example of commercially available carboxylates, Emcol CLA-40, a $C_{12-14}$ alkyl polyethoxy (4) carboxylic acid, and Emcol CNP-110, a $C_9$ alkylaryl polyethoxy (10) carboxylic acid are available from Witco Chemical. Carboxylates are also available from Sandoz, e.g. the product Sandopan® DTC, a $C_{13}$ alkyl polyethoxy (7) carboxylic acid.

The second active component in the alkaline cleaner composition is a strong chelating agent preferably in the form of its alkaline metal salt such as sodium or preferably the potassium salt. Chelating or sequestering agents are those molecules capable of coordinating the metal ions commonly found in hard water and thereby preventing the metal ions, e.g., Ca and Mg, from interfering with the functioning of the detersive component of the composition. Strong chelating agents are aminopolycarboxylic acids such as, for example, nitrilotriacetic acid (NTA), ethylenediaminetetraacetic acid (EDTA), N-hydroxyethyl-ethylenediamine triacetic acid (HEDTA), and diethylene-triamine pentaacetic acid (DTPA). In an embodiment, the chelating agent can be a potassium based chelating agent, such as $K_4$EDTA, TKPP, KTPP, and the like.

The third active component of the present alkaline cleaner composition is a source of alkalinity which can be an organic source or an inorganic source. Organic sources of alkalinity are often strong nitrogen bases including, for example, ammonia (ammonium hydroxide), monoethanolamine, monopropanolamine, diethanolamine, dipropanolamine, triethanolamine, tripropanolamine, and the like.

The inorganic alkaline source contained in the alkaline cleaners of this invention is preferably derived from sodium or potassium hydroxide. The preferred form is commercially available potassium hydroxide, which can be obtained in aqueous solution of concentrations of about 45 wt %. In an embodiment, the source of alkalinity can be a potassium based source of alkalinity, such as potassium hydroxide, potassium carbonate, potassium metasilicate, potassium silicate, potassium borate, $K_2O$, and the like.

In an embodiment, preferred sources of alkalinity include ammonia or ammonium hydroxide, monoethanolamine, and potassium hydroxide. Potassium hydroxide in 45 wt % aqueous solution is preferred. In an embodiment, most preferred is a combination of the three.

The composition of the present invention is manufactured in either a concentrate formulation or dilute aqueous formulation. All formulations are prepared initially in concentrated form by combining the ingredients in a mixing vessel and mixing the components creating a homogeneous liquid composition.

The resulting concentrate may be diluted and bottled for household purposes for cleaning bathroom tiles.

Preferably, the concentrate is sold as such for institutional and commercial settings which require a significant amount of the compositions. The purchased concentrated composition is then diluted to the proper strength at the site where they will be used. Systems for diluting concentrates are well known in the art and are normally employed by a wide variety of users, e.g. hotels, hospitals, restaurants, etc. Dispensing systems may cover a wide range in terms of complexity. The method of dilution may be rather simple and manual or require operator experience. A preferred method for dispensing a concentrate is described in U.S. Pat. No. 5,033,649 which is incorporated herein by reference. The solution storage and dispensing apparatus has a container with two inlet ports for two different types of liquid e.g. a water and the liquid cleaning concentrate. The inlet ports for the two different types of liquid accommodate two inlet lines which transport the liquid into the container. The inlet lines are each removably interconnected to their respective liquid sources and container inlet ports. The container has a suitable proportioning means, such as an aspirator, permanently mounted inside of it.

The present invention may be better understood with reference to the following examples. These examples are intended to be representative of specific embodiments of the invention, and are not intended as limiting the scope of the invention.

The alkaline cleaner compositions of the present invention were compared with other known surfactants. The data demonstrated the superiority of the present compositions in removing soil containing grease and lime-soaps from hard surfaces such as found in commercial and institutional kitchen floors. The data also demonstrated the superiority of compositions that contain potassium ion, but not sodium ion, in food soil removal and, particularly, in drying time.

EXAMPLES

Example 1

Typical Restaurant Floor Soil

Samples of greasy soil from seven local restaurants were collected. These samples were scraped from the grout lines between tiles. Fourier transform infrared spectroscopy (FTIR) and nuclear magnetic resonance (NMR) analyses were made on these soil samples. The results are shown in Table 1. The soils are quite similar, and average 30–40% fats (unsaturated fatty triglycerides), 20–30% Ca or Mg fatty salts, 15–20% proteins, and the remainder being glucosides and inorganics.

The presence and levels of fats, proteins, glucosides, and inorganics were expected. What was truly surprising was the high amounts of free fatty acids, which were complexed as the alkaline earth (Ca or Mg) salts. The free fatty acids were apparently generated from high temperature cooking (deep frying, etc.) on the triglycerides. The alkaline earth ions were either from the floor tile or grout, or from the water hardness in the water used for cleaning.

These alkaline earth salts of fatty acids, commonly called lime-soaps, are not only extremely insoluble in water but also very hydrophobic and not wetted by water, making their removal difficult.

TABLE 1

FTIR analyses of grout samples

| Restaurant | Fats | Fatty Salts | Proteins | Glucosides and Inorganics |
|---|---|---|---|---|
| McGoverns | 30–40 | 10–20 | 10–20 | remainder |
| Back Street | 30–40 | 10–20 | 20–30 | remainder |
| Parker House | <5 | 10–15 | 30–40 | remainder |
| Awadas | 10–20 | 20–30 | <10 | remainder |
| St. Clair Broiler | 50–60 | 10–20 | <15 | remainder |
| Pannekoeken | 50–60 | 20–30 | 15–20 | remainder |
| Razzberrys | 20–30 | 20–30 | 30–40 | remainder |
| AVERAGE | 30–40 | 20–30 | 15–20 | remainder |

*Results are in percent.
The fats reported are unsaturated fatty triglycerides (NMR).

Example 2

Floor Cleaner Soil Removal Lab Test

A model floor soil was designed based on the above study of several restaurant floor soil samples. This simulated floor soil and the subsequent floor soil removal laboratory test procedure was used to test various cleaners.

Procedure

Quarry tiles soiled with a special Ca soil mixture were baked at two different temperatures: 300° F. for 1½ hours and 200° F. for 3 hours. The tiles were read on the Relative Spectral Reflectance machine before running a test. The tiles were then measured after Gardner Straight Line treatment.

The Gardner Straight Line Washability apparatus, model WG 6700 was used to clean standard soiled tiles with standard pressure and stroke of a swatch towel, using dilution concentrations of detergents.

Apparatus and Materials:

1. Gardner Straight Line apparatus with plastic template, 21 15/16"×6 15/16"×⅛". One hole 6×6".
2. Relative Spectral Reflectance machine.
3. Cream, solid quarry tile, 6×6" panels. Supplier: Color Tile, St. Paul, Minn.
4. Swatch towel, 6×6".
5. Scour pad, 6×6".
6. Paint brush, 1" width, to deliver 5.0 gm of soil.
7. 6×6" stainless steel plate with screws.
8. Stainless steel disc. (825 gm).

Calcium Soil Formula

| | |
|---|---|
| Powdered milk | 16.67% |
| Corn oil | 29.50% |
| Ca Linoleate | 10.00% |
| Ca Oleate | 6.67% |
| Ca stearate | 3.33% |
| Red Iron Oxide | 0.50% |
| IPA 99% (isopropyl alcohol) | 33.33% |

Ca Soil Mixing Procedure

Add the ingredients in order into a 800 ml plastic beaker. Blend them well with a spatula before mixing. The soil mixture will be mixed with the Tekmar mixer for 5 to 10 minutes. Mix until uniform. Cover the beaker with plastic wrap. Do not leave soil uncovered for any length of time as the IPA evaporates. the minimum batch size is about 500 gm for adequate mixing with the Tekmar.

Tile Soiling Procedure

1. Stir the soil well before applying (a small amount of IPA may be added if the soil has dried somewhat). Apply 5.0 gm of soil (a balance can be used) with a paint brush to the tile surface.

2. The tiles will be baked at two different temperatures at 300° F. for 1½ hours and 200° F. for 3 hours.

Soil Removal Test Procedure

1. Make up typically at 2 oz/gal (1.5 wt. %) of each product to be tested.

2. Screw the swatch and a green scouring pad together in the stainless steel plate. Put Stainless steel disc weight on top.

3. Place soiled tile into the plastic template inside the Washability apparatus.

4. Transfer 200 gm of test solution into the Washability apparatus pan.

5. Start the machine immediately, washing the tiles for 150 cycles at 300° F. and 100 cycles at 200° F. conditions.

6. Remove tiles and rinse with cool water.

7. Allow the tiles to air dry.

8. Have a final reading as Delta Reflectance for the tiles following the same procedure as before.

9. Also, make visual estimates for percents soil removal in this test.

Calculations

Delta Reflectance is determined by the final reading (R2) and the initial reading (R1)

Delta Reflectance=R2–R1

Visual soil removal estimates are used to complement the delta reflectance readings.

Visual estimates can be graded with a scale that is comfortable to the operator. For example, one can use a scale of 0 to 100 percent removal or use a scale of 1 to 4.

1=0–25%

2=25–50%

3=50–75%

4=75–100%

Floor Soil Removal Test Results and Discussion

Table 2 show 8 formulations labeled Modified OASIS 111-1 to 8. These were designed to be compared with an Ecolab liquid alkaline floor cleaner product, OASIS 111. The formulations were also designed to have roughly matching costs. The formulations were made up by mixing the ingredients named in Table 2 for each OASIS numbered sample in distilled (D1) water. Each formulation contains the same percentages of perfume and dyes-pine perfume, 0.1 wt %; Acid Green 25, an anthraquinone dye, 0.005 wt %; Yellow 8 BR (Acid Yellow 23), 0.006 wt %. OASIS 111 and modified OASIS 111-1 contain HF-055, an alcohol ethoxylate of a $C_{12}$–$C_{14}$ alcohol and 18 mole ethylene oxide adduct, Ecolab, as an active ingredient. OASIS 111-2 and 111-3 contain in varying amounts as active ingredients a combination of Rewoteric AMB-14, cocamido propylbetaine, Rewo Chemical Group, Steol CS-460, sodium laureth sulfate, Stepan Chemical Co., and Supra 2, lauryldimethylamine oxide, Ecolab. The latter combination is known to remove loose (non-polymerized) grease. Finally, samples labeled OASIS 111-4 to 111-8 contain as an active ingredient an alcohol ethoxy carboxylate of the present invention, EMCOL CNP-110, having the formula

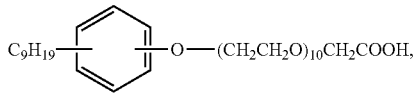

available from WITCO Chemical Corp.

The lab floor soil removal test results are shown at the bottom of Table 2.

The test results generally show the superiority of Emcol CNP-110, an excellent lime-soap dispersant, over HF-055, and the combination of Rewoteric AMB-14/Steol CS-460/Supra 2.

TABLE 2

| | | MODIFIED | | | | | | | |
|---|---|---|---|---|---|---|---|---|---|
| RAW MATERIAL | OASIS 111 | OASIS 111-1 | OASIS 111-2 | OASIS 111-3 | OASIS 111-4 | OASIS 111-5 | OASIS 111-6 | OASIS 111-7 | OASIS 111-8 |
| D1 WATER (BALANCE) | | | | | | | | | |
| NaOH, 50% | 2.0 | 2.0 | 2.0 | 2.0 | 2.0 | 2.0 | 10.0 | | 6.0 |
| RU SILICATE | 3.0 | | | | | | | | |
| MEA, 99% | 6.0 | 6.0 | 6.0 | | 6.0 | | | 8.0 | 6.0 |
| $NH_4OH$, 30% | 2.0 | 2.0 | 2.0 | 2.0 | 2.0 | | | | |
| $NH_3$ | | | | | | | | | |
| BUTYL CELLOSOLVE | 4.0 | | | | | | | | |
| HF-055 | 3.0 | 3.0 | | | | | | | |
| REWOTERIC | | | 2.0 | 5.5 | | | | | |
| AMB-14 | | | (0.6) | (1.65) | | | | | |
| STEOL CS-460 | | | 0.5 | 1.375 | | | | | |
| | | | (0.3) | (0.83) | | | | | |
| SUPRA 2 | | | 0.5 | 1.375 | | | | | |
| | | | (0.15) | (0.41) | | | | | |
| EMCOL | | | | (1.30) | 2.0 | 4.0 | 3.6 | 2.0 | 2.0 |

TABLE 2-continued

| RAW MATERIAL | OASIS 111 | MODIFIED OASIS 111-1 | OASIS 111-2 | OASIS 111-3 | OASIS 111-4 | OASIS 111-5 | OASIS 111-6 | OASIS 111-7 | OASIS 111-8 |
|---|---|---|---|---|---|---|---|---|---|
| CNP-110 | | | | | (2.60) | (2.34) | (1.30) | (1.30) | |
| VERSENE 100 | 7.0 | 13.0 | 13.0 | 13.0 | 13.0 | 13.0 | 13.0 | 13.0 | 13.0 |
| DYE & PERFUME (q.s.) | | | | | | | | | |
| RELATIVE % REMOVAL OF SOIL BAKED AT 300° F. FOR 1.5 HOURS; PRODUCT TESTED AT 1.5%. | | | | | | | | | |
| 1ST SERIES | 35.0 | 46.0 | 42.0 | 28.0 | | | | | |
| 2ND SERIES | 35.0 | 50.0 | | | 65.0 | 30.0 | 50.0 | 52.0 | 60.0 |
| RELATIVE % REMOVAL OF SOIL BAKED AT 200° F. FOR 3.0 HOURS; PRODUCT TESTED AT 1.5%. | | | | | | | | | |
| 1ST SERIES | 12.0 | 19.0 | 17.0 | 9.6 | | | | | |
| 2ND SERIES | 12.0 | 12.0 | | | 15.0 | 15.0 | 25.0 | 15.0 | 20.0 |

Note:
Numbers in parentheses are % of surfactants adjusted to 100% activity.

Lime Soap Dispersing Test:

In this test, the abilities of various reputedly good lime-soap dispersants were compared with the alkaline cleaner compositions of the present invention in removing pre-formed calcium stearate, calcium oleate, and calcium linoleate in aqueous solution. The concentration of the surfactants used was 2 wt % and the concentration of the lime-soap used was 0.2%. The surfactants tested were:

| | Trade Name/Manufacturer |
|---|---|
| Sodium laureth sulfate | Steol CS-460/Stepan |
| Cocamidopropyl hydroxy sultaine | Varion CAS-W/Sherex |
| Alkylated naphthalene sulfonate, sodium salt | Morwet D-425/Witco |
| $C_{12}$–$C_{14}$ Alkyl polyethoxy (4) carboxylic acid | Emcol CLA-40/Witco |
| $C_9$ Alkylaryl polyethoxy (10) carboxylic acid | Emcol CNP-110/Witco |

The test results indicate that Steol CS-460, Varion CAS-W, and Morwet D-425 have very minimal lime-soap removing abilities. On the other hand, the test results show Emcol CLA-40 and Emcol CNP-110 of the present invention to be excellent lime-soap removal agents and also good solubilizing agents (fraction of the lime-soap is solubilized in solution, not just suspended from precipitating).

Example 3

Potassium Ion Improves Performance of Cleaners Containing Alkyl Aryl Ethoxy Carboxylate and Amine Oxide Potassium ion was substituted for sodium ion, and the potassium ion containing composition was compared to the sodium ion containing compositions for soil removal, drying time, and appearance after cleaning and drying.

Materials and Methods

TABLE 1

| Raw Material | Formulations A | B |
|---|---|---|
| DI water | 75.1 | 80.1 |
| KOH, 45% | 14.0 | — |
| NaOH, 50% | — | 9.0 |
| Versene Acid (ethylene diamine tetra acetic acid) | 4.7 | 4.7 |
| Sandopan DTC Acid (Tridecyl polyethoxy (7) carboxylic acid) | — | — |
| Emcol CNP-110 ($C_9$ alkyl aryl polyethoxy (10) carboxylic acid) | 2.0 | 2.0 |
| Barlox 12 (30% $C_{12}$ dimethyl amine oxide) | 2.0 | 2.0 |
| Ammonium Hydroxide (26% $NH_3$) | 2.0 | 2.0 |
| Dyes and Fragrance | 0.17 | 0.17 |

Each composition contained the same molar concentration of alkali metal hydroxide, but one contained potassium hydroxide and the other sodium hydroxide. The cleaning performances of the two were compared on quarry kitchen floors soiled with a thick layer of deep-fried grease.

Results and Discussion

The results were surprising. Formulation A ($K^+$ containing) substantially outperformed Formulation B ($Na^+$ containing) in soil removal, shorter drying time, and improved appearance after cleaning and drying.

The benefit of a shorter drying time is significant. For example, kitchen workers quite often walk on a floor soon after it is washed. If the floor is still wet from cleaning, the walking will result in footprints, which are undesirable.

Example 4

Potassium Ion Improves Performance of Cleaners Containing Alkyl Ethoxy Carboxylate With and Without Amine Oxide Another experiment compared drying time and soil removal with formulas containing alkyl ethoxy carboxylate, with and without amine oxide, and containing either $K^+$ or $Na^+$.

Materials and Methods

TABLE 2

| Raw Material | Formulations 1 | 2 | 3 | 4 |
|---|---|---|---|---|
| DI water | 77.3 | 75.3 | 82.3 | 80.3 |
| KOH, 45% | 14.0 | 14.0 | — | — |
| NaOH, 50% | — | — | 9.0 | 9.0 |
| Versene Acid (ethylene diamine tetraacetic acid) | 4.7 | 4.7 | 4.7 | 4.7 |
| Sandopan DTC Acid (Tridecyl polyethoxy (7) carboxylic acid) | 2.0 | 2.0 | 2.0 | 2.0 |
| Emcol CNP-110 ($C_9$ alkyl aryl polyethoxy (10) carboxylic acid) | — | — | — | — |
| Barlox 12 (30% $C_{12}$ dimethyl amine oxide) | — | 2.0 | — | 2.0 |
| Ammonium Hydroxide (26% $NH_3$) | 2.0 | 2.0 | 2.0 | 2.0 |
| Dyes and Fragrance | — | — | — | — |

The formulations were made up with city water at 2 oz per gallon dilution, at 6.5 oz per gallon dilution, and at 13 oz per gallon dilution.

The drying time test was done at room temperature on a 6"×6" red quarry tile inclined at about 60°. The bottom 3" of the tile was wetted with each test solution, and the drying time was measured. The initial drying time denoted the time at which the tile was dried except for a ledge of test solution pooled at the bottom. The complete drying time denoted the time when the ledge of test solution pooled at the bottom edge eventually dried.

The soil removal tests were conducted by a modified PFA method. Briefly: 3"×3" White vinyl tiles were soiled with approximately ¾ g of various soils using a 3" foam brush. Soil removal testing was conducted with the Precession Force Applicator (PFA), using 4×3×¾ inch sponge saturated with 50 g test product and @ 2 lb pressure, turning the test tile 90° four times after designated cycles. Each test includes placing two soiled tiles into 200 g of test solution for presoaking and then inserted into the PFA in direction with the grain. The PFA was set to the "Vinyl Soil" program. Test solutions were made with soft water. For red food soil, the presoaking was conducted for 1 min and scrubbing was conducted with a 4 cycle scrub×four 90° rotations of test tile. For oily soil, presoaking was conducted for 2 min and scrubbing was conducted with a 10 cycle scrub×four 90° rotations of test tile.

The percent soil removal was determined with the Mini Hunter Lab D65/10° reflectance (L* reflectance value, Program #98) before and after scrubbing. The percent soil removal was calculated according to the equation:

$$\% \text{ Removal} = \frac{(\text{Scrubbed Soil Reading} - \text{Soil Reading})}{(\text{Initial Tile Reading} - \text{Soil Reading})} \times 100$$

Results and Discussion

Table 3 summarizes the drying time test results for this study. Table 3A reports the results from employing the 2 oz/gallon composition. Table 3B reports the results from employing the 13 oz/gallon composition. Table 4 summarizes the removal properties of dilutions of the formulas on a lab red food soil. Table 5 summarizes the removal properties of dilutions of the formulas on a lab black oily soil. These results are also summarized graphically in FIGS. 1 and 2.

The results demonstrated at least that: Alkyl ethoxy carboxylates and alkyl aryl ethoxy carboxylates provided similar results. $K^+$-containing formulas outperformed the respective $Na^+$-containing formulas both in soil removal (e.g., against the food soil) and drying time. The further incorporation of a nonionic surfactant (an amine oxide in this example) into these alcohol ethoxy carboxylate—based systems enhances detergency, at least against the black oily soil.

TABLE 3

| Formula | Drying Times on Quarry Tiles: Initial Drying Time | Complete Drying Time |
|---|---|---|
| TABLE 3A - 2 oz/gallon | | |
| 1 | 4 min 30 sec | 11 min 45 sec |
| 2 | 4 min 15 sec | 10 min 30 sec |
| 3 | 5 min 30 sec | 14 min |
| 4 | 5 min 40 sec | 14 min 30 sec |
| A | 3 min 30 sec | 8 min |
| TABLE 3B - 13 oz/gallon | | |
| 1 | 3 min 15 sec | 6 min 30 sec |
| 2 | 3 min 45 sec | 10 min |
| 3 | 4 min 30 sec | 7 min 30 sec |
| 4 | 5 min | 15 min |
| A | 4 min | 8 min 30 sec |

TABLE 4

| Formula | Red Food Soil Removal Test Results: Dilution | % Removal | Average | Std. Dev. |
|---|---|---|---|---|
| TABLE 4A - 2 oz/gallon | | | | |
| 1 | 2 oz/gal | 47.46<br>57.57 | 52.51 | 7.15 |
| 2 | 2 oz/gal | 58.94<br>51.32 | 55.13 | 5.39 |
| 3 | 2 oz/gal | 55.03<br>50.99 | 53.01 | 2.86 |
| 4 | 2 oz/gal | 44.80<br>50.72 | 47.76 | 4.18 |
| A | 2 oz/gal | 52.23<br>50.70 | 51.46 | 1.09 |

TABLE 4-continued

| Formula | Dilution | % Removal | Average | Std. Dev. |
|---|---|---|---|---|
| Red Food Soil Removal Test Results | | | | |
| TABLE 4B - 6.5 oz/gallon | | | | |
| 1 | 6.5 oz/gal | 66.28 | 66.92 | 0.91 |
| | | 67.57 | | |
| 2 | 6.5 oz/gal | 67.32 | 66.58 | 1.05 |
| | | 65.83 | | |
| 3 | 6.5 oz/gal | 69.46 | 67.85 | 2.27 |
| | | 66.24 | | |
| 4 | 6.5 oz/gal | 65.14 | 67.91 | 3.92 |
| | | 70.68 | | |
| A | 6.5 oz/gal | 68.85 | 68.34 | 0.72 |
| | | 67.83 | | |
| TABLE 4C - 13 oz/gallon | | | | |
| 1 | 13 oz/gal | 72.72 | 72.32 | 0.57 |
| | | 71.91 | | |
| 2 | 13 oz/gal | 72.16 | 71.93 | 0.32 |
| | | 71.70 | | |
| 3 | 13 oz/gal | 62.69 | 63.07 | 0.53 |
| | | 63.44 | | |
| 4 | 13 oz/gal | 64.40 | 65.20 | 1.13 |
| | | 66.00 | | |
| A | 13 oz/gal | 73.39 | 72.96 | 0.60 |
| | | 72.53 | | |

TABLE 5

| Formula | Dilution | % Removal | Average | Std. Dev. |
|---|---|---|---|---|
| Black Oily Soil Removal Test Results | | | | |
| TABLE 5A -- 2 oz/gallon | | | | |
| 1 | 2 oz/gal | 37.63 | 36.07 | 2.20 |
| | | 34.51 | | |
| 2 | 2 oz/gal | 41.76 | 40.60 | 1.65 |
| | | 39.43 | | |
| 3 | 2 oz/gal | 41.29 | 42.62 | 1.88 |
| | | 43.95 | | |
| 4 | 2 oz/gal | 49.60 | 46.60 | 4.24 |
| | | 43.60 | | |
| A | 2 oz/gal | 40.74 | 39.01 | 2.45 |
| | | 37.28 | | |
| TABLE 5B -- 6.5 oz/gallon | | | | |
| 1 | 6.5 oz/gal | 41.91 | 44.92 | 4.26 |
| | | 47.94 | | |
| 2 | 6.5 oz/gal | 39.83 | 38.18 | 2.34 |
| | | 36.52 | | |
| 3 | 6.5 oz/gal | 50.80 | 49.30 | 2.13 |
| | | 47.79 | | |
| 4 | 6.5 oz/gal | 46.25 | 47.73 | 2.10 |
| | | 49.21 | | |
| A | 6.5 oz/gal | 42.42 | 43.28 | 1.21 |
| | | 44.13 | | |
| TABLE 5C -- 13 oz/gallon | | | | |
| 1 | 13 oz/gal | 44.70 | 43.28 | 2.01 |
| | | 41.86 | | |
| 2 | 13 oz/gal | 52.13 | 49.37 | 3.90 |
| | | 46.61 | | |
| 3 | 13 oz/gal | 41.89 | 44.26 | 3.35 |
| | | 46.63 | | |
| 4 | 13 oz/gal | 45.81 | 49.13 | 4.70 |
| | | 52.46 | | |
| A | 13 oz/gal | 47.27 | 47.32 | 0.08 |
| | | 47.37 | | |

Example 5

Potassium Ion Improves Performance of Cleaners Containing Alkyl Aryl Ethoxy Carboxylate With and Without Amine Oxide Another experiment compared formulas containing alkyl aryl ethoxy carboxylate, with and without amine oxide, and containing either $K^+$ or $Na^+$.

Materials and Methods

TABLE 6

| Raw Material | 5 | 6 | 7 | 8 |
|---|---|---|---|---|
| Formulations | | | | |
| DI water | 77.3 | 75.3 | 82.3 | 80.3 |
| KOH, 45% | 14.0 | 14.0 | — | — |
| NaOH, 50% | — | — | 9.0 | 9.0 |
| Versene Acid (ethylene diamine tetra acetic acid) | 4.7 | 4.7 | 4.7 | 4.7 |
| Sandopan DTC Acid (Tridecyl polyethoxy (7) carboxylic acid) | — | — | — | — |
| Emcol CNP-110 ($C_9$ alkyl aryl polyethoxy (10) carboxylic acid) | 2.0 | 2.0 | 2.0 | 2.0 |
| Surfonic PEA-25 (ethoxylated ether amine) | — | 2.0 | — | 2.0 |
| Ammonium Hydroxide (26% $NH_3$) | 2.0 | 2.0 | 2.0 | 2.0 |
| Dyes and Fragrance | — | — | — | — |

The formulations were made and the drying time and soil removal tests were conducted as described above in Example 4.

Results and Discussions

Table 7 summarizes the drying time test results for this study. Table 8 summarizes the removal properties of dilutions of the formulas on a lab red food soil. Table 9 summarizes the removal properties of dilutions of the formulas on a lab black oily soil. These results are also summarized graphically in FIGS. 3 and 4. The descriptions of these two soil removal tests can be found in a later section.

The results of this study parallel those obtained in Example 4. These tests indicated that the faster drying advantage of $K^+$ compared to $Na^+$ is maintained with alkyl aryl ethoxy carboxylate.

TABLE 7

| Formula | Initial Drying Time min:sec | Complete Drying Time min:sec |
|---|---|---|
| Drying Times on Quarry Tiles | | |
| TABLE 7A - 2 oz/gallon | | |
| 5 | 3:20 | 12:20 |
| 6 | 3:20 | 7:30 |
| 7 | 5:15 | 10:00 |
| 8 | 4:00 | 5:00 |
| TABLE 7B - 13 oz/gallon | | |
| 5 | 4:30 | 15:45 |
| 6 | 3:45 | 16:00 |
| 7 | 4:30 | 7:00 |
| 8 | 3:30 | 10:00 |

TABLE 8

| Formula | Dilution | % Removal | Average | Std. Dev. |
|---|---|---|---|---|
| Red Food Soil Removal Test Results | | | | |
| TABLE 8A -- 2 oz/gallon | | | | |
| 5 | 2 oz/gal | 38.30 | 40.02 | 2.43 |
| | | 41.73 | | |
| 6 | 2 oz/gal | 41.80 | 41.99 | 0.28 |
| | | 42.19 | | |
| 7 | 2 oz/gal | 43.29 | 44.52 | 1.73 |
| | | 45.75 | | |
| 8 | 2 oz/gal | 41.66 | 42.54 | 1.25 |
| | | 43.43 | | |
| TABLE 8B -- 6.5 oz/gallon | | | | |
| 5 | 6.5 oz/gal | 55.68 | 55.38 | 0.43 |
| | | 55.08 | | |
| 6 | 6.5 oz/gal | 57.06 | 56.95 | 0.15 |
| | | 56.85 | | |
| 7 | 6.5 oz/gal | 55.40 | 54.93 | 0.66 |
| | | 54.47 | | |
| 8 | 6.5 oz/gal | 57.21 | 58.56 | 1.90 |
| | | 59.90 | | |
| TABLE 8C -- 13 oz/gallon | | | | |
| 5 | 13 oz/gal | 63.31 | 64.46 | 1.63 |
| | | 65.61 | | |
| 6 | 13 oz/gal | 65.23 | 65.38 | 0.21 |
| | | 65.52 | | |
| 7 | 13 oz/gal | 64.64 | 64.65 | 0.02 |
| | | 64.67 | | |
| 8 | 13 oz/gal | 67.78 | 67.27 | 0.72 |
| | | 66.76 | | |

TABLE 9

| Formula | Dilution | % Removal | Average | Std. Dev. |
|---|---|---|---|---|
| Black Oily Soil Removal Test Results | | | | |
| Table 9A -- 2 oz/gallon | | | | |
| 5 | 2 oz/gal | 42.33 | 41.38 | 1.35 |
| | | 40.42 | | |
| 6 | 2 oz/gal | 40.59 | 39.73 | 1.22 |
| | | 38.86 | | |
| 7 | 2 oz/gal | 48.80 | 47.60 | 1.71 |
| | | 46.39 | | |
| 8 | 2 oz/gal | 45.92 | 46.14 | 0.31 |
| | | 46.36 | | |
| Table 9B -- 6.5 oz/gallon | | | | |
| 5 | 6.5 oz/gal | 49.71 | 49.04 | 0.95 |
| | | 48.37 | | |
| 6 | 6.5 oz/gal | 49.13 | 48.65 | 0.68 |
| | | 48.17 | | |
| 7 | 6.5 oz/gal | 55.11 | 54.14 | 1.37 |
| | | 53.16 | | |
| 8 | 6.5 oz/gal | 54.49 | 54.08 | 0.58 |
| | | 53.68 | | |
| Table 9C -- 13 oz/gallon | | | | |
| 5 | 13 oz/gal | 53.79 | 53.02 | 1.09 |
| | | 52.25 | | |
| 6 | 13 oz/gal | 52.33 | 52.84 | 0.72 |
| | | 53.35 | | |
| 7 | 13 oz/gal | 55.36 | 55.14 | 0.32 |
| | | 54.92 | | |
| 8 | 13 oz/gal | 52.19 | 53.53 | 1.89 |
| | | 54.87 | | |

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

All publications and patent applications in this specification are indicative of the level of ordinary skill in the art to which this invention pertains.

The invention has been described with reference to various specific and preferred embodiments and techniques. However, it should be understood that many variations and modifications may be made while remaining within the spirit and scope of the invention.

What is claimed is:

1. An alkaline cleaner composition consisting essentially of:

about 0.1–20 wt-% of an alkyl ethoxy carboxylate of the formula:

$$R—O—(CH_2CH_2O)_n(CH_2)_m—CO_2X$$

wherein R is a $C_8$–$C_{22}$ alkyl group, n is an integer of 1–20, m is an integer of 1–3, and X is hydrogen, sodium, potassium, lithium, ammonium, or an amine cation;

the amine being monoethanolamine, diethanolamine, or triethanolamine;

about 1–20 wt-% of a chelating agent, the chelating agent being nitrilotriacetic acid, ethylenediamine tetraacetic acid, N-hydroxyethyl-ethylenediamine triacetic acid, diethylene-triamine pentaacetic acid, or combination thereof; the chelating agent being effective to prevent metal ions such as calcium and magnesium from interfering with the functioning of the detersive component of the composition; and

8–30 active wt-% of a source of alkalinity.

2. The composition of claim 1, wherein n is an integer of 4–10 and m is 1.

3. The composition of claim 2, wherein R is a $C_8$–$C_{16}$ alkyl group.

4. The composition of claim 3, wherein R is a $C_{12}$–$C_{14}$ alkyl group, n is 4 and m is 1.

5. The composition of claim 4, wherein the chelating agent is ethylenediaminetetraacetic acid.

6. The composition of claim 4, wherein the alkaline source is monoethanolamine, potassium hydroxide, ammonium hydroxide, or mixtures thereof.

7. The composition of claim 1, wherein the chelating agent is ethylenediaminetetraacetic acid, nitrilotriacetic acid, alkali metal salt thereof, or combination thereof.

8. The composition of claim 1, wherein the alkaline source is monoethanolamine, diethanolamine, triethanolamine, potassium hydroxide, ammonia, ammonium hydroxide, or mixture thereof.

9. The composition of claim 1, wherein the alkaline source is potassium hydroxide.

10. The composition of claim 1, wherein the composition is in solid or liquid form.

11. The composition of claim 1, comprising amine oxide surfactant.

12. A method for removing soil from hard surfaces comprising:

applying to said surface a diluted alkaline cleaner composition, which consists essentially of in concentrate form:

about 0.1–20 wt-% of an alkyl ethoxy carboxylate of the formula;

$$R—O—(CH_2CH_2O)_n(CH_2)_m—CO_2X$$

wherein R is a $C_8$–$C_{22}$ alkyl group, n is an integer of 1–20, m is an integer of 1–3, and X is hydrogen, sodium, potassium, lithium, ammonium, or an amine cation;

the amine being monoethanolamine, diethanolamine or triethanolamine;

about 1–20 wt-% of a chelating agent, the chelating agent being nitrilotriacetic acid, ethylenediamine tetraacetic acid, N-hydroxyethyl-ethylenediamine triacetic acid, and diethylene-triamine pentaacetic acid, and 8–30 active wt-% of a source of alkalinity.

13. The method of claim 12, wherein n is an integer of 4–10 and m is 1.

14. The method of claim 13, wherein R is a $C_8$–$C_{16}$ alkyl group.

15. The method of claim 14, wherein R is a $C_{12}$–$C_{14}$ alkyl group, n is 4 and m is 1.

16. The method of claim 15, wherein the chelating agent is ethylenediaminetetraacetic acid.

17. The method of claim 15, wherein the alkaline source is monoethanolamine, potassium hydroxide, ammonium hydroxide, or mixtures thereof.

18. The method of claim 12, wherein the chelating agent is ethylenediaminetetraacetic acid, nitrilotriacetic acid, alkali metal salt thereof, or combination thereof.

19. The method of claim 12, wherein the alkaline source is monoethanolamine, diethanolamine, triethanolamine, potassium hydroxide, ammonia, ammonium hydroxide, or mixture thereof.

20. The method of claim 12, wherein the alkaline source is potassium hydroxide.

21. The method of claim 12, wherein the composition is in solid or liquid form.

22. An alkaline cleaner composition consisting essentially of:

about 0.1–20 wt-% of an alkylaryl ethoxy carboxylate of the formula:

$$R—O—(CH_2CH_2O)_n(CH_2)_m—CO_2X$$

wherein R is $R^1$

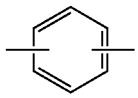

in which $R^1$ is a $C_4$–$C_{16}$ alkyl group, n is an integer of 1–20, m is an integer of 1–3, and X is potassium;

about 1–20 wt-% of a chelating agent selected from the group consisting of nitrilotriacetic acid, ethylenediamine tetraacetic acid, N-hydroxyethyl-ethylenediamine triacetic acid, and diethylene-triamine pentaacetic acid; and 2–30 active wt-% of a source of alkalinity.

23. The composition of claim 22, wherein R is

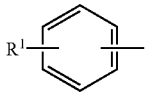

in which $R^1$ is a $C_6$–$C_{12}$ alkyl group.

24. The composition of claim 23, wherein $R^1$ is a $C_9$ alkyl group, n is 10 and m is 1.

25. The composition of claim 22, wherein n is an integer of 4–10 and m is 1.

26. The composition of claim 22, wherein the chelating agent is ethylenediaminetetraacetic acid.

27. The composition of claim 22, wherein the alkaline source is monoethanolamine, potassium hydroxide, ammonium hydroxide, or mixtures thereof.

28. The composition of claim 22, wherein the chelating agent is ethylenediaminetetraacetic acid, nitrilotriacetic acid, potassium salt thereof, or combination thereof.

29. The composition of claim 22, wherein the alkaline source is monoethanolamine, diethanolamine, triethanolamine, potassium hydroxide, ammonia, ammonium hydroxide, or mixture thereof.

30. The composition of claim 22, wherein the alkaline source is potassium hydroxide.

31. The composition of claim 22, wherein the composition is in solid or liquid form.

32. The composition of claim 22, comprising amine oxide surfactant.

33. A method for removing soil from hard surfaces comprising:

applying to said surface a diluted alkaline cleaner composition, which consists essentially of in concentrate form:

about 0.1–20 wt-% of an alkylaryl ethoxy carboxylate of the formula;

$$R—O—(CH_2CH_2O)_n(CH_2)_m—CO_2X$$

wherein R is $R^1$

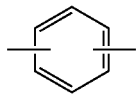

in which $R^1$ is a $C_4$–$C_{16}$ alkyl group, n is an integer of 1–20, m is an integer of 1–3, and X is potassium;

about 1–20 wt-% of a chelating agent selected from the group consisting of nitrilotriacetic acid, ethylenediamine tetraacetic acid, N-hydroxyethyl-ethylenediamine triacetic acid, and diethylene-triamine pentaacetic acid, and 2–30 active wt-% of a source of alkalinity.

34. The method of claim 33, wherein R is

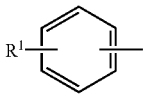

in which $R^1$ is a $C_6$–$C_{12}$ alkyl group.

35. The method of claim 34, wherein $R^1$ is a $C_9$ alkyl group, n is 10 and m is 1.

36. The method of claim 33, wherein n is an integer of 4–10 and m is 1.

37. The method of claim 33, wherein the chelating agent is ethylenediaminetetraacetic acid.

38. The method of claim 33, wherein the alkaline source is monoethanolamine, potassium hydroxide, ammonium hydroxide, or mixtures thereof.

39. The method of claim 33, wherein the chelating agent is ethylenediaminetetraacetic acid, nitrilotriacetic acid, potassium salt thereof, or combination thereof.

40. The method of claim 33, wherein the alkaline source is monoethanolamine, diethanolamine, triethanolamine, potassium hydroxide, ammonia, ammonium hydroxide, or mixture thereof.

41. The method of claim 33, wherein the alkaline source is potassium hydroxide.

42. The method of claim 33, wherein the composition is in solid or liquid form.

43. An alkaline cleaner composition comprising:

about 0.1–20 wt-% of an alkyl ethoxy carboxylate of the formula:

$$R—O—(CH_2CH_2O)_n(CH_2)_m—CO_2X$$

wherein R is a $C_8$–$C_{22}$ alkyl group, n is an integer of 1–20, m is an integer of 1–3, and X is hydrogen, sodium, potassium, lithium, ammonium, or an amine cation;

the amine being monoethanolamine, diethanolamine, or triethanolamine;

about 1–20 wt-% of a chelating agent, the chelating agent being nitrilotriacetic acid, ethylenediamine tetraacetic acid, N-hydroxyethyl-ethylenediamine triacetic acid, diethylene-triamine pentaacetic acid, or combination thereof; the chelating agent being effective to prevent metal ions such as calcium and magnesium from interfering with the functioning of the detersive component of the composition; and 8–30 active wt-% of a source of alkalinity;

wherein the composition is effective for removing greasy and lime soap soil and for providing reduced drying time.

44. An alkaline cleaner composition comprising:

about 0.1–20 wt-% of an alkylaryl ethoxy carboxylate of the formula:

$$R—O—(CH_2CH_2O)_n(CH_2)_m—CO_2X$$

wherein R is $R^1$

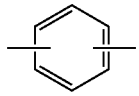

in which $R^1$ is a $C_4$–$C_{16}$ alkyl group, n is an integer of 1–20, m is an integer of 1–3, and X is potassium;

about 1–20 wt-% of a chelating agent selected from the group consisting of nitrilotriacetic acid, ethylenediamine tetraacetic acid, N-hydroxyethyl-ethylenediamine triacetic acid, and diethylene-triamine pentaacetic acid; and 2–30 active wt-% of a source of alkalinity;

wherein the composition is effective for removing greasy and lime soap soil and for providing reduced drying time.

* * * * *